US007994442B2

(12) United States Patent
Vestner et al.

(10) Patent No.: US 7,994,442 B2
(45) Date of Patent: Aug. 9, 2011

(54) RACK GEAR FOR ELECTRICAL CIRCUIT BREAKER

(75) Inventors: Markus Vestner, Büsingen (CH); Olaf Hunger, Schaffhausen (CH)

(73) Assignee: ABB Technology AG, Zurich (CH)

( * ) Notice: Subject to any disclaimer, the term of this patent is extended or adjusted under 35 U.S.C. 154(b) by 875 days.

(21) Appl. No.: 11/826,018

(22) Filed: Jul. 11, 2007

(65) Prior Publication Data

US 2008/0047813 A1 Feb. 28, 2008

(30) Foreign Application Priority Data

Jul. 12, 2006 (EP) ..... 06405301

(51) Int. Cl.
*H01H 31/00* (2006.01)

(52) U.S. Cl. ..... 200/48 V

(58) Field of Classification Search ..... 200/48 V, 200/48 R

See application file for complete search history.

(56) References Cited

U.S. PATENT DOCUMENTS

| | | | | |
|---|---|---|---|---|
| 5,478,980 | A | 12/1995 | Freeman et al. | |
| 5,578,806 | A * | 11/1996 | Hofbauer et al. | 218/59 |
| 6,015,960 | A * | 1/2000 | Girodet et al. | 218/43 |
| 2009/0008367 | A1 * | 1/2009 | Kriegel et al. | 218/62 |

FOREIGN PATENT DOCUMENTS

| | | | |
|---|---|---|---|
| EP | 0 313 813 | A1 | 5/1989 |
| EP | 0 696 040 | A1 | 2/1996 |
| EP | 0 785 562 | A1 | 7/1997 |
| EP | 0 907 195 | A1 | 4/1999 |
| EP | 0 999 569 | A2 | 5/2000 |
| WO | 99/12177 | A1 | 3/1999 |

OTHER PUBLICATIONS

European Search Report.

* cited by examiner

*Primary Examiner* — Renee Luebke
*Assistant Examiner* — Lheiren Mae Caroc
(74) *Attorney, Agent, or Firm* — Buchanan Ingersoll & Rooney PC

(57) ABSTRACT

The disclosure relates to an electrical breaker device with double movement of its contact systems. An auxiliary gear is designed for driving the second contact systems such that the holding means for holding the rack and pinion gear and the guiding means for slide guiding and slide contacting the auxiliary-gear-driven arcing contact piece are constructed integrally in a monoblock. Embodiments, among others, relate to: a pusher guide slide bearing recessed in the arcing contact piece that is driven by the auxiliary gear; a minimal configuration of the toothed rack drive with only one cog-wheel; and a limit stop for defining an end position for the auxiliary-gear-driven arcing contact piece. Advantages, among others, are: auxiliary gear with reduced number of parts, and simplified mounting and adjustment.

20 Claims, 1 Drawing Sheet

RACK GEAR FOR ELECTRICAL CIRCUIT BREAKER

RELATED APPLICATIONS

This application claims priority under 35 U.S.C. §119 to EP Application 06405301.0 filed in Europe on Jul. 12, 2006, the entire contents of which are hereby incorporated by reference in their entireties.

TECHNICAL FIELD

The invention is directed to the field of high-voltage technology, particularly high-voltage switchgear in electric power distribution networks. It is based on an interrupter unit for a circuit breaker and a circuit breaker.

RELATED ART

The invention is based on the related art as disclosed in the applicant's own European Patent No. EP 0 313 813 A1. In that document, a circuit breaker with a breaker drive is described, which moves the first arcing contact piece and also drives the opposing, second arcing contact piece via an auxiliary gear that is linked to the insulation nozzle. The auxiliary gear has two gearwheels, each of which cooperates with two toothed racks or cogging mechanisms arranged parallel to the axis of the circuit breaker. The first toothed racks are permanently connected to the insulation nozzle. The second toothed rack has two cogging mechanisms and is connected to the arcing contact pin. The gearwheels are rotated by the axial motion of the insulation nozzle and the first toothed racks, and in turn drive the second toothed rack axially in the opposite direction. The auxiliary gear comprises an assembly plate or mounting that accommodates the gearwheel bearings and is fixed to the external nominal current contact. The auxiliary gear further includes a guiding block, which accommodates the guide slide bearings for axial guidance of the arcing contact pin and is also secured to the external nominal current contact. The mounting and the guiding block constitute two separate assemblies, which must be inserted into the circuit breaker, aligned and mounted independently of one another in two separate assembly operations. Additionally, it must be ensured that the movements of the two first toothed racks are precisely synchronized, because the first toothed racks engage with cogging mechanisms that are arranged flush with each other on the same, second toothed rack, with the result that both are coupled in force-fit manner to the arcing contact pin. Accordingly, the first toothed racks must be adjusted so that they are flush with one another. This is achieved most simply by adjusting them so that they are assembled with their respective cogging mechanisms equidistant from the insulation nozzle.

A refinement of the circuit breaker with dual toothed rack drive is disclosed in the applicant's own European Patent No. EP 0 999 569 A1. The sliding contact arrangement comprises a sliding contact ring that is firmly fixed to the arcing contact pin and is supported on its outer side by the inner surface of the surrounding contact tube, and is guided in sliding manner along this tube. The sliding contact ring is connected to the arcing contact pin via radial spokes.

Although in EP 0 313 813 A1 and EP 0 999 569 A1 an auxiliary gear with only one gearwheel, with one driving rack and one driven rack is mentioned, they are associated with problems of one-sided loading, wear or tilting, which have not yet been solved. Accordingly, a mirror-symmetrical arrangement with two gearwheels and four toothed racks is presented as the preferred configuration, and is the only configuration that has been used for practical purposes to date.

A further variant of the circuit breaker, with dual toothed rack drive, is described in the applicant's own U.S. Pat. No. 5,478,980. The assembly plate for accommodating the gearwheels is mounted on the guiding block via axially extending pillars. The guiding block incorporates the guide slide bearings, and is itself fixed to the external nominal current contact. The lengths of the toothed racks are adjustable with adjusting screws. In this way, the driving toothed racks may be adjusted to be flush with one another more easily.

SUMMARY

The object of the present invention is to suggest a simplified construction for a circuit breaker with dual movement of the arcing contacts.

The invention consists in an interrupter unit for an electrical circuit breaker, in particular a high-voltage circuit breaker, for power supply networks, wherein the circuit breaker has a central axis, an insulation nozzle for arc blowing, a first contact system, a second contact system, and a circuit breaker drive that drives the first contact system and also drives the second contact system via an auxiliary gear, wherein the auxiliary gear has holding means and guiding means for a toothed rack drive, wherein the auxiliary gear comprises a monoblock in which the holding means and guiding means for the toothed rack drive are integrated. The integral construction in one monoblock reduces the number of components and simplifies the assembly and adjustment of the auxiliary gear in the circuit breaker.

In an advantageous embodiment, a pusher guide slide bearing is recessed into the arcing contact piece that is driven by the auxiliary gear. In this way, the arcing contact piece may be prevented from tilting in a particular effective and durabe manner.

In a further advantageous embodiment, the toothed rack gear has exactly one gearwheel, exactly one first toothed rack for driving the gearwheel, and exactly one second toothed rack for moving the second arcing contact. Reducing the number to exactly one gearwheel, which cooperates with exactly one driving toothed rack and exactly one cogging mechanism in the arcing contact piece, enables a significantly simplified construction of the auxiliary gear without sacrificing any of the reliability of the circuit breaker drive.

In a further advantageous embodiment, a limit stop is provided for the arcing contact piece that is driven by the auxiliary gear. Accordingly, complicated adjustments need not be made to the toothed rack when the circuit breaker is equipped with the auxiliary gear.

Additional embodiments relate to design variants of the monoblock and its mounting in the circuit breaker, and to design variants of the toothed rack drive, and to an electrical circuit breaker having an arcing interrupter unit as described above, and having the advantages described above.

Additional embodiments, advantages, and applications of the invention will be evident from the following description and figures.

BRIEF DESCRIPTION OF THE DRAWINGS

The drawings show schematically and in exemplary manner in.

In the figures, identical or equivalent parts are provided with identical or similar reference numbers.

DETAILED DESCRIPTION

Figure 2:
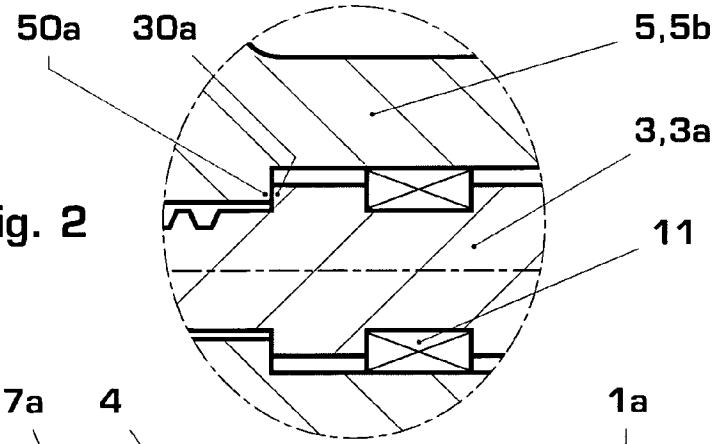
Figure 1:
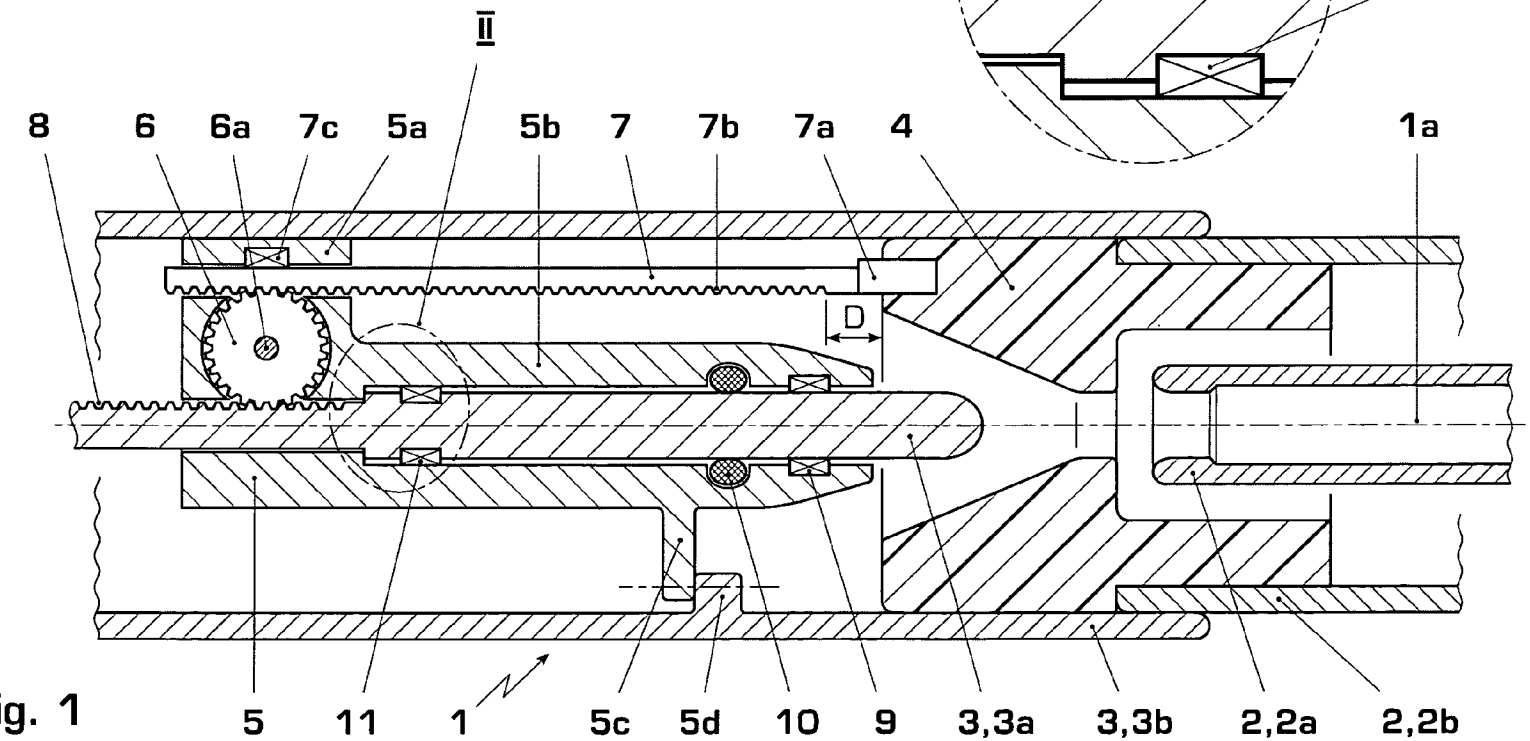
FIG. 1 a circuit breaker with auxiliary gear for double-movement of arcing contacts; and in FIG. 2 a detailed view relating to FIG. 1.

FIG. 1 shows a schematic partial representation of the arc extinction interrupter unit for an electrical circuit breaker 1, for exemplary purposes here a power circuit breaker. The interrupter unit has a central axis 1*a* and at least one first contact system 2 with an insulation nozzle 4 for blowing an arc, a second contact system 3, and a circuit breaker drive (not shown). The circuit breaker drive drives the first contact system 2 and, via an auxiliary gear 5, . . . , 11, the second contact system 3. Typically, the contact pieces 2, 3 are located concentrically with respect to the central axis 1*a*. In this case, the first contact system 2 comprises a first arcing contact 2*a* in form of a contact tulip 2*a* and a first nominal current contact 2*b* arranged externally that has the form of a contact tube 2*b*. In this case, the second contact system 3*a* comprises a second arcing contact 3*a* that has the form of a contact pin 3*a*, and second nominal current contact 3*b* arranged externally that has the form of a contact tulip 3*b*. The insulation nozzle 4 is for example attached to the nominal current contact 2*b* on the first contact system 2. Besides the main nozzle 4, a secondary nozzle (not shown) may also be present. When the circuit breaker is operated, extinction gas flows into the arcing zone between the arcing contacts 2*a*, 3*a* and blow the arc. It should be noted that the invention described in the following may be used in any circuit breaker type with double movement of the contact systems 2, 3, and in particular in self-extinguishing or self-blast circuit breakers.

According to the invention, the auxiliary gear 5 to 11 comprises a monoblock 5, in which holding means 5*a* and guiding means 5*b* for toothed rack drive 6 to 8 are constructively integrated. The monoblock represents a monolithic assembly, which may be fitted as a complete single-piece unit or may be equipped with elements before it is fitted as a complete unit in the breaker. Exemplary embodiments of such will be described in the following.

The monoblock 5 should comprise a holding means 5*a*, in which a bearing is provided for at least one cogwheel 6 of the toothed rack drive 6 . . . 8; and/or the monoblock 5 should comprise in its guiding means 5*a* one guide slide bearing 9, 11 and one sliding contact 10 for the arcing contact piece 3*a* that is driven by auxiliary gear 5 . . . 11; and/or the monoblock 5 should be connected in electrically conductive manner to the externally arranged nominal current contact 3*b* in order to draw current from the arcing contact piece 3*a*.

The monoblock 5 advantageously forms a single assembly unit 5, which may be inserted into the circuit breaker 1 completely as a single unit, and/or the monoblock 5 is constructed as a single-piece unit. In particular, the monoblock 5 may be a single-piece cast part 5.

In order to make installation of the monoblock 5 on circuit breaker 1 as simple as possible, only a single mounting fixture 5*c*, 5*d* is present. As is shown in the example, the monoblock 5 may have exactly one mounting flange 5*c*, which is attachable to exactly one mating flange 5*d* on the circuit breaker 1.

In an advantageous configuration, a pusher guide slide bearing 11 is recessed directly in the arcing contact piece 3*a* that is driven by the auxiliary gear 5 . . . 11. This reduces the danger of tilting even during single-sided driving, as will be described below. Alternatively or in addition, a fixed guide slide bearing 9 may be recessed in the guiding means 5*b* of the monoblock 5 for guiding the arcing contact piece 3*b* that is or may be driven by the auxiliary gear 5 . . . 11. This combination of the features of the guide slide bearing 9, 11, in particular the combination of a pusher guide slide bearing 11 in the rear part of the arcing contact piece 3*a*, which faces away from the arcing zone, with a fixed guide slide bearing 9 in the front part of the arcing contact piece 3*a*, which faces towards the arcing zone, may also be implemented regardless of the construction as a monoblock.

In a further advantageous configuration, the toothed rack gear 6 . . . 8 has exactly one gearwheel 6, exactly one first toothed rack 7 for driving the gearwheel 6, and exactly one second toothed rack 8 for moving the second arcing contact 3*a*. In such a case, adjustment screws are no longer needed to ensure that several driving toothed racks are adjusted to be flush with each other.

Insulation nozzle 4 is advantageously movable and serves for transmitting force from the circuit breaker drive to the auxiliary gear 5 . . . 11. The first toothed rack 7 is attached to the insulation nozzle 4. The first toothed rack 7 is preferably constructed such that it may be screwed into the insulation nozzle 4, with the axial distance D between its cogging 7*b* and the insulation nozzle 4 being adjustable. Moreover, adjusting screws on the first toothed rack 7 for adjusting the length of first toothed rack 7 should be absent. In fact, the length of the toothed rack need not be adjusted in the construction with only one toothed rack 7 either, provided precisely defined distances are maintained between the insulation nozzle 4 and the cogging 7*b*. This may be realized particularly easily in the construction of the monoblock.

For this purpose, in an advantageous embodiment, a limit stop 30*a*, 50*a* is provided for the arcing contact piece 3*a* that is driven by the auxiliary gear 5 . . . 11. This limit stop 30*a*, 50*a* may be created by providing a shoulder 30*a* (protruding or recessed) on the arcing contact piece 3*a*, which shoulder cooperates with an opposing shoulder 50*a* (protruding or recessed) on the monoblock 5 in such manner, that an end position is defined for the arcing contact piece 3*a*, when it is fully inserted, which end position corresponds to a desired, predeterminable distance to the opposing arcing contact piece 3*b* or to the insulation nozzle 4, respectively.

A further object of the invention is an electrical circuit breaker 1 for a power supply network with an interrupter unit as described above. The circuit breaker may, in particular, be a gas-blast circuit breaker or a self-blast circuit breaker; and/or a high-voltage circuit breaker 1 or a high-current circuit breaker, or generally a power circuit breaker; and/or a life tank circuit breaker, an encapsulated circuit breaker as dead tank breaker or for a gas-insulated switchgear assembly, or a hybrid circuit breaker.

Another object of the invention relates to a method for assembling the circuit breaker 1 with an interrupter unit as described previously. In this context, the insulation nozzle 4 is pre-assembled with the at least one toothed driving rack 7 in the circuit breaker 1. According to the invention, the following assembly steps are performed: (i) Inserting the arcing contact piece 3*a* that is driven by auxiliary gear 5 . . . 11 into the monoblock 5 as far as limit stop 30*a*, 50*a*; (ii) Inserting the monoblock 5 into the circuit breaker 1 until mounting fixtures 5*c*, 5*d* come in touch with one another; and (iii) using the mounting fixtures 5*c*, 5*d* to secure monoblock 5 inside the circuit breaker 1. The toothed rack transmission 6 . . . 8 may thus be adjusted and set particularly easily due to the construction as a monoblock.

LIST OF REFERENCE SYMBOLS

1 Electrical circuit breaker, high-voltage circuit breaker, power circuit breaker

1*a* Central axis, circuit breaker axis

2 First contact system (with insulation nozzle)
2*a* First arcing contact, arcing contact tulip
2*b* First nominal current contact, contact tube
3 Second contact system, opposite contact system
3*a* Second arcing contact, arcing contact piece
30*a* Limit stop
3*b* Second nominal current contact, nominal current contact tulip
4 Insulation nozzle
5 to 11 Auxiliary gear
5 Transmission block (single part)
5*a* Holding means, holder for gearwheel bearing, assembly plate
50*a* Opposing limit stop
5*b* Guiding means, guidance for arcing contact
5*c*, 5*d* Mounting means, mounting fixture
5*c* Protrusion, mounting flange
5*d* Protrusion, mating flange
6 to 8 Toothed rack drive
6 Gearwheel
6*a* Gearwheel axis, gearwheel bearing
7 First toothed rack, driving toothed rack
7*a* Threaded joint, adjusting screw
7*b* Cogging
7*c* Bearing
8 Second toothed rack, driven toothed rack
9 First bearing ring, fixed guide slide bearing
10 Sliding contact
11 Second bearing ring, traveling guide slide bearing, pusher guide slide bearing
D Axial distance from cogging to insulation nozzle

What is claimed is:

1. An interrupter unit for an electrical circuit breaker for power supply networks, the interrupter unit comprising:
a central axis;
a first contact system having an insulation nozzle for arc blowing;
an auxiliary gear;
a second contact system; and
a circuit breaker drive which drives the first contact system and also drives the second contact system via the auxiliary gear, wherein:
the auxiliary gear comprises holding means and guiding means for a toothed rack drive;
the auxiliary gear comprises a monoblock in which the holding means and the guiding means for the toothed rack drive are integrated;
the toothed rack drive has exactly one gearwheel, exactly one first toothed rack for driving the gearwheel, and exactly one second toothed rack for moving a second arcing contact piece of the second contact system.

2. The interrupter unit as claimed in claim 1, wherein:
the monoblock has in its holding means a bearing for at least one gearwheel; and/or
the monoblock has in its guiding means a guide slide bearing and a sliding contact for an arcing contact piece that is driven by the auxiliary gear; and/or
the monoblock is electrically conductively connected to an external nominal current contact in order to draw current from the arcing contact piece.

3. The interrupter unit as claimed in claim 1, wherein:
the monoblock forms a single assembly unit, which is configured to be inserted into the circuit breaker as a single unit; and/or
the monoblock is constructed as a single-piece unit.

4. The interrupter unit as claimed in claim 3, wherein the monoblock is constructed as a single-piece cast part.

5. An electrical circuit breaker for a power supply network, comprising an interrupter unit as claimed in claim 1.

6. The electrical circuit breaker as claimed in claim 5, wherein the circuit breaker is at least one of:
a gas-blast circuit breaker; and/or
a high-voltage circuit breaker or a high-current circuit breaker, and/or
a life tank circuit breaker, an encapsulated breaker for a dead tank breaker or for a gas-insulated switchgear assembly, or a hybrid circuit breaker.

7. The interrupter unit as claimed in claim 6, wherein the circuit breaker is a self-blast circuit breaker.

8. The interrupter unit as claimed in claim 1, wherein:
the insulation nozzle is movable and is configured to transmit force from the circuit breaker drive to the auxiliary gear; and
the first toothed rack is attached to the insulation nozzle.

9. The interrupter unit as claimed in claim 1, wherein the electrical circuit breaker is a high-voltage circuit breaker.

10. An interrupter unit for an electrical circuit breaker for power supply networks, the interrupter unit comprising:
a central axis;
a first contact system having an insulation nozzle for arc blowing;
an auxiliary gear;
a second contact system; and
a circuit breaker drive which drives the first contact system and also drives the second contact system via the auxiliary gear,
wherein the auxiliary gear comprises holding means and guiding means for a toothed rack drive;
wherein the auxiliary gear comprises a monoblock in which the holding means and the guiding means for the toothed rack drive are integrated, and wherein
a single mounting fixture is present for attaching the monoblock to the circuit breaker, and
the monoblock has exactly one mounting flange, which is attachable to exactly one mating flange on the circuit breaker.

11. An interrupter unit for an electrical circuit breaker for power supply networks, the interrupter unit comprising:
a central axis;
a first contact system having an insulation nozzle for arc blowing;
an auxiliary gear;
a second contact system; and
a circuit breaker drive which drives the first contact system and also drives the second contact system via the auxiliary gear,
wherein the auxiliary gear comprises holding means and guiding means for a toothed rack drive;
wherein the auxiliary gear comprises a monoblock in which the holding means and the guiding means for the toothed rack drive are integrated, and wherein
a pusher guide slide bearing is recessed in an arcing contact piece that is driven by the auxiliary gear, and/or
a fixed guide slide bearing is recessed in the guiding means of the monoblock for guiding the arcing contact piece that is driven by the auxiliary gear.

12. The interrupter unit as claimed in claim 11, wherein the toothed rack drive has exactly one gearwheel, exactly one first toothed rack for driving the gearwheel, and exactly one second toothed rack for moving a second arcing contact piece.

13. An interrupter unit for an electrical circuit breaker for power supply networks, the interrupter unit comprising:
a central axis;

a first contact system having an insulation nozzle for arc blowing;

an auxiliary gear;

a second contact system; and a circuit breaker drive which drives the first contact system and also drives the second contact system via the auxiliary gear, wherein:

the auxiliary gear comprises holding means and guiding means for a toothed rack drive;

the auxiliary gear comprises a monoblock in which the holding means and the guiding means for the toothed rack drive are integrated;

the insulation nozzle is movable and is configured to transmit force from the circuit breaker drive to the auxiliary gear; and a first toothed rack is attached to the insulation nozzle and configured to be screwed into the insulation nozzle with an adjustable axial distance between its cogging and the insulation nozzle, wherein the first toothed rack has no adjusting screws for adjusting the length of the first toothed rack.

14. The interrupter unit as claimed in claim 13, comprising:

a limit stop provided for an arcing contact piece that is driven by the auxiliary gear.

15. The interrupter unit as claimed in claim 14, wherein the limit stop is constituted by a shoulder in the arcing contact piece, and an opposing shoulder that cooperates therewith is constituted on the monoblock.

16. An interrupter unit for an electrical circuit breaker for power supply networks, the interrupter unit comprising:

a central axis;

a first contact system having an insulation nozzle for arc blowing;

an auxiliary gear;

a second contact system; and a circuit breaker drive which drives the first contact system and also drives the second contact system via the auxiliary gear, wherein:

the auxiliary gear comprises holding means and guiding means for a toothed rack drive;

the auxiliary gear comprises a monoblock in which the holding means and the guiding means for the toothed rack drive are integrated; and a limit stop is provided for an arcing contact piece that is driven by the auxiliary gear.

17. An electrical circuit breaker for a power supply network, comprising an interrupter unit as claimed in claim 16.

18. The interrupter unit as claimed in claim 16, wherein the limit stop is constituted by a shoulder in the arcing contact piece, and an opposing shoulder that cooperates therewith is constituted on the monoblock.

19. A method for assembling a circuit breaker with an interrupter unit, wherein the interrupter unit comprises a central axis, a first contact system having an insulation nozzle for arc blowing, an auxiliary gear, a second contact system, and a circuit breaker drive which drives the first contact system and also drives the second contact system via the auxiliary gear, wherein the auxiliary gear comprises holding means and guiding means for a toothed rack drive, wherein the auxiliary gear comprises a monoblock in which the holding means and the guiding means for the toothed rack drive are integrated, wherein the insulation nozzle is pre-assembled with a driving toothed rack in the circuit breaker, and wherein the method comprises the steps of:

inserting an arcing contact piece that is driven by the auxiliary gear into the monoblock as far as a limit stop;

inserting the monoblock into the circuit breaker until mounting fixtures of the monoblock come in touch with one another; and using the mounting fixtures to secure the monoblock inside the circuit breaker.

20. A method for assembling a circuit breaker with an interrupter unit as claimed in claim 16, wherein the insulation nozzle is pre-assembled with a driving toothed rack in the circuit breaker, the method comprising the steps of:

inserting the arcing contact piece that is driven by the auxiliary gear into the monoblock as far as the limit stop;

inserting the monoblock into the circuit breaker until mounting fixtures of the monoblock come in touch with one another; and using the mounting fixtures to secure the monoblock inside the circuit breaker.

* * * * *